United States Patent [19]

Desmeules

[11] Patent Number: 5,059,948

[45] Date of Patent: Oct. 22, 1991

[54] ANTI-THEFT SECURITY DEVICE AND ALARM

[75] Inventor: Claude Desmeules, Indianapolis, Ind.

[73] Assignee: Tronics 2000, Inc., Indianapolis, Ind.

[21] Appl. No.: 557,979

[22] Filed: Jul. 26, 1990

[51] Int. Cl.[5] ..... G08B 13/14

[52] U.S. Cl. ..... 340/568; 340/687; 439/917

[58] Field of Search ..... 340/568, 652, 687, 428; 439/489, 917

[56] References Cited

U.S. PATENT DOCUMENTS

| | | | |
|---|---|---|---|
| 4,035,765 | 7/1977 | Wenner et al. | 340/428 |
| 4,620,183 | 10/1986 | Kottelman | 340/568 |
| 4,727,449 | 2/1988 | Fleck | 340/652 X |
| 4,746,909 | 5/1988 | Israel et al. | 340/568 |
| 4,760,382 | 7/1988 | Faulkner | 340/568 X |

*Primary Examiner*—Glen R. Swann, III
*Assistant Examiner*—Thomas J. Mullen, Jr.
*Attorney, Agent, or Firm*—Woodard, Emhardt, Naughton, Moriarty & McNett

[57] ABSTRACT

An anti-theft security device and alarm for detection of the disconnection of electronic equipment such as video cassette recorders from a series electronic signal path loop is disclosed. The chassis of the VCR or other electronic audio-visual equipment is used to complete a series connection between a security circuit and a ground potential signal so that disconnection of the electronic equipment on diplay from the sucurity circuit will cause an open circuit condition. The open circuit condition is detected by an alarm circuit, and the alarm circuit responds by producing an alarm signal which is supplied to audio and visual signalling devices to produce audible and visible theft alert signals.

17 Claims, 1 Drawing Sheet

ANTI-THEFT SECURITY DEVICE AND ALARM

BACKGROUND OF THE INVENTION

This invention relates to security devices and more specifically to devices which detect unauthorized removal of products displayed on retailers shelves.

Theft of expensive electronic devices is a continuing problem faced by most retailers in the retail industry. In particular, audiovisual products such as video cassette recorders (or VCRs) command a very high price and are likely targets for theft. In response to this social ailment, most retailers have invested in expensive electronic security and/or anti-theft devices for monitoring the status of in-house equipment which is currently on display for inspection by the consuming public.

Existing anti-theft devices are cumbersome to install and require a customized electrical connection to monitor and detect disconnection and/or removal of audio/-visual electronic devices displayed on retailers' shelves. Other security systems include tracking devices attached to electronic equipment which act as an electronic key to trigger an alarm when the equipment is taken through an electronic gateway or arch near the exit of the store.

An electronic anti-theft security device which does not require special or customized connections to electronic merchandise displayed on retailers' shelves will enable the retailer to monitor unauthorized removal of electronic equipment and more specifically to determine when one of those devices has been removed or disconnected from its installation location.

SUMMARY OF THE INVENTION

In accordance with one aspect of the present invention, an anti-theft device for detecting the disconnection of an electronic device which includes a first connector and a second connector, the first and second connectors each having a signal conductor and a common conductor and wherein the common conductors of the first and second connectors are electrically shorted, comprises circuit means for producing an alarm signal, the circuit means including a loop input and a loop output, the circuit means producing an alarm signal when the loop input is electrically disconnected from the loop output, a source connector connected to the first connector, the first source connector including a signal conductor and a common conductor which are connected to the respective conductors of the first connector, the loop input also connected to the common conductor of the source connector, a playback connector connected to the second connector, the playback connector including a signal conductor and a common conductor which are connected to the respective conductors of the second connector, the loop output also connected to the playback connector common conductor, and alarm means responsive to the alarm signal for indicating when the alarm signal is present.

It is one object of the present invention to provide an improved anti-theft device for detecting theft of audio-visual or other expensive electronic equipment.

It is a further object of the present invention to provide an anti-theft device which conveniently connects to electronic equipment and requires no special or customized connections to the electronic equipment.

It is yet another object of the present invention to provide a more economical and yet more simplistic security system for preventing the theft of electronic equipment.

These and other objects of the present invention will become more apparent from the following description of the preferred embodiment.

DESCRIPTION OF THE PREFERRED EMBODIMENT

Figure 1:
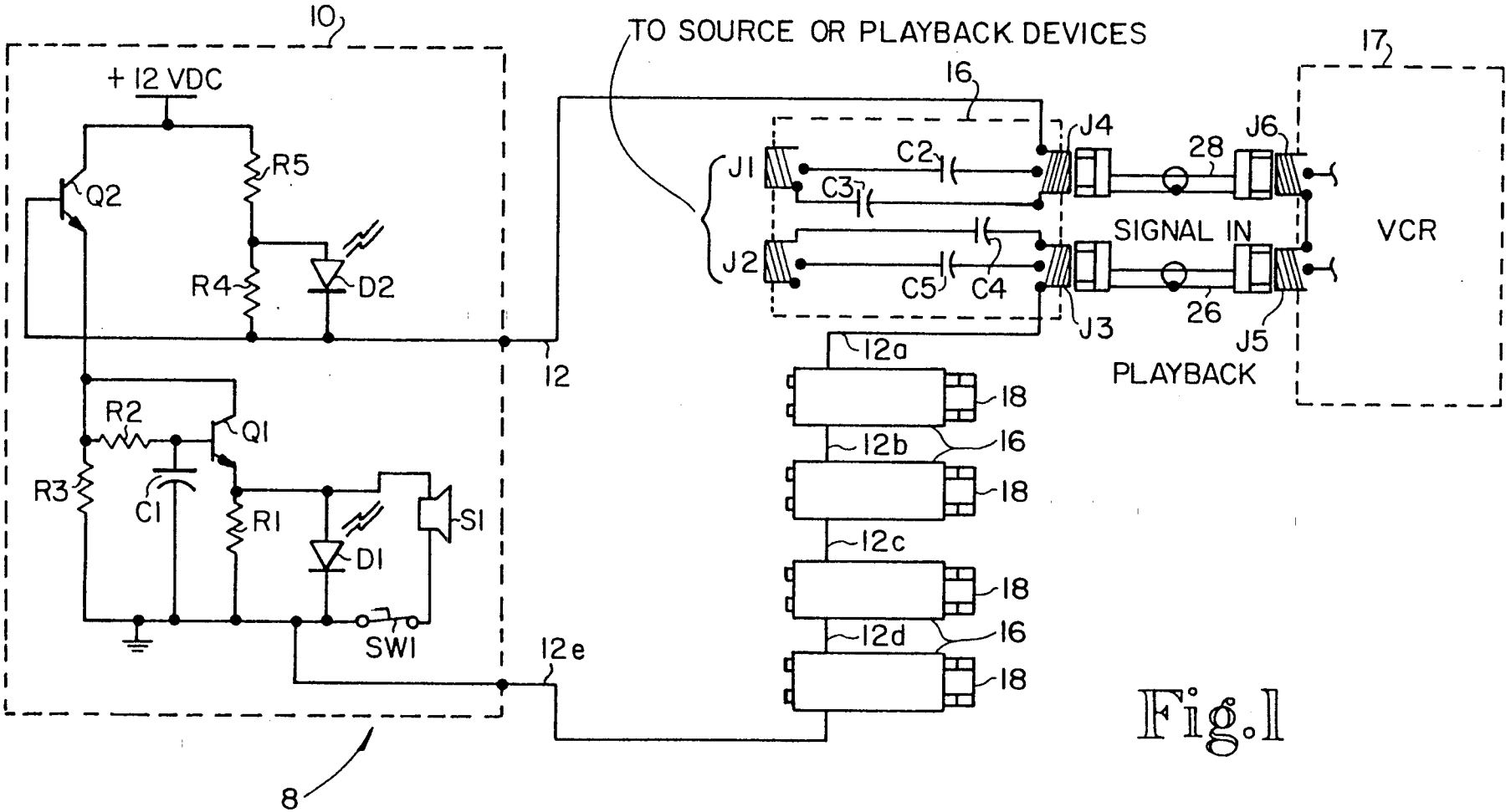
FIG. 1 is a schematic illustration of the anti-theft device according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a schematic illustration of the anti-theft device 8 according to the present invention is shown. The device 8 includes alarm circuitry 10 which is electrically connected to connection modules 16. Each connection module 16 is connected, via electrical cables such as cables 26 and 28, to a VCR 17 or a dummy connector module 18 which simulates the presence of a VCR. Each connection module 16 includes identical components and the uppermost module depicted in FIG. 1 is representative of the components found within each connection module 16.

Alarm circuitry 10 provides a means for detecting an open circuit condition between signal path 12 and a ground potential appearing on signal path 12*e*. Alarm circuitry 10 includes two transistors, Q1 and Q2, utilized as electronic switching devices. The base of transistor Q2 is connected to signal path 12 and to the shield or ground connection of connector J4. When an electronic device such as VCR 17 is connected to a connection module 16, the internal chassis ground of VCR 17 provides a series connection path internal within the VCR for shorting the ground shield of connector J4 to that of connector J3. Coaxial cables 26 and 28 connect, for example, the input (RF IN or Antenna In connector) and playback (RF OUT to a television) connection jacks or connectors of VCR 17 to corresponding signal connectors or to a switching unit (not shown) which is typically connected to connectors J1 and J2 of module 16 in retail stores. Switching units, commonplace in retail merchandise stores specializing in audio and video equipment retailing, enable a user to connect the input and output of an electronic device to a matrix of other signal sources or playback devices for demonstration purposes.

In the embodiment shown, connectors J1, J2, J3, and J4 are F-type coaxial connectors typically used in cable TV installations. Connection module 16 is a wall-mount feedthrough device which provides a convenient and attractive means for connecting to a VCR. The signals present on connectors J1 and J4 are DC isolated by capacitors C2 and C3 on the signal conductor connection as well as the shield or common conductor connection. Thus, AC signals emanating from VCR 17 will pass from connector J4 to connector J1 and DC signals present on the shield and signal conductor connections of connector J4 are blocked by capacitors C2 and C3 from reaching connector J1, and vice versa. In like manner, capacitors C4 and C5 provide DC isolation for connectors J2 and J3 allowing AC signals to pass yet blocking DC signals on both the signal conductor connection and the shield or common conductor connection.

Signal path 12 is electrically connected to the shield of connector J4, the shield of connector J6, the shield of connector J5, and the shield of connector J3 when coaxial cables 26 and 28 are installed as shown in FIG. 1. Once installed, coaxial cables 26 and 28 complete a circuit for signal path 12 to be shorted electrically to signal path 12*a*. In like manner, other devices similar to VCR 17 may be connected to the remaining connection modules 16. Alternatively, jumper blocks 18 provide an electrical short between the shield of connector J4 and J3 for each of the remaining modules 16 if no additional electronic devices such as VCR 17 need be displayed and also monitored for theft.

When signal path 12 is shorted to signal path 12*a*, 12*b*, 12*c*, 12*d*, and 12*e*, a completed circuit is formed to short signal path 12 to ground potential. When signal path 12 is electrically shorted to signal paths 12*a*–12*e*, the base of transistor Q2 is shorted to ground and transistor Q2 is turned "off." In addition, resistors R5 and R4 then establish a voltage divider and provide an appropriate voltage across light emitting diode (LED) D2 to illuminate LED D2 and indicate that the loop connection through all the connection modules 16 (signal paths 12 and 12*a*–12*e*) is complete to a ground level potential or voltage.

If VCR 17 or any of the jumpers 18 is removed from any of the modules 16, signal path 12 will no longer be directly shorted to signal path 12*e*. In the event this occurs, the base of transistor Q2 will float and allow transistor Q2 to begin to conduct current, and thereby supply a power signal to the collector of transistor Q1. (A 10K ohm pull-up resistor may also be used to ensure that the base of Q2 will rise to +12 VDC when signal path 12 is no longer shorted to ground potential.) In addition, a voltage is supplied to the junction between resistors R2 and R3 from the emitter of transistor Q2. When the voltage across capacitor C1 begins to rise, the voltage at the base of transistor Q1 will reach a point at approximately 0.6 or 0.7 volts when transistor Q1 will be "turned on" so that the voltage from collector to emitter of Q1 will be approximately 0.1 to 0.3 volts. When this occurs, a power signal or current is supplied to speaker or siren S1 and light emitting diode (LED) D1. The speaker and LED provide an audible and visual indication that the serially connected loop of connections through the modules 16 has been electrically broken or opened. Audible and visual alarms indicate that the series of connections between the modules is no longer complete, and thus a VCR 17 or one of the jumper blocks 18 has been removed from one of the modules 16.

An advantageous aspect of the device 8 shown in FIG. 1 is that once a sales person installs a VCR 17 to one of the connection modules 16, and activates the audible alarm by turning a key lock which is coupled to switch SW1 to close the circuit between speaker S1 and ground, security device is armed without any additional connections over and above those normally required to demonstrate the operating features of the VCR 17. It should be recognized that additional VCRs may be connected into the anti-theft circuit by removing jumper block 18 from module 16 and interconnecting as is shown in the exemplary connections with VCR 17. It should also be recognized that a relatively large number of modules 16 may be tied together in series to form a security system which can monitor the presence of several hundred VCRs. Once a VCR is disconnected at either connector J5 or J6 from a corresponding connection module 16, the series connections are broken and signal path 12 is no longer shorted to signal path 12*e* thus resulting in a triggering of the alarm.

Component values for the electrical schematic components of FIG. 1 are listed in Table 1, including tolerance values and industry standard designations for the parts. Connectors J1, J2, J3, and J4 are standard F type connectors which are mounted on the front and back of a module 16 designed to mount quickly to a smooth surface such as a wall or display stand. In addition, capacitors C2, C3, C4, and C5 are mounted on the backside of a wall plate which is mountable on any wall and resembles the standard wall feedthrough used in cable television installations where two signals are passed through a solid wall. Coaxial cables 26 and 28 are mateable with standard F connector type female connectors such as J1–J6. Twisted pair cable and any type of two-pin connectors can be substituted for the coaxial cables and connectors shown. The electronic alarm circuitry 10 is powered by a 12 volt DC power supply (not shown) available in a variety of forms from power supply manufacturers. Siren S1 is a device designed to produce a very loud alarm signal (approximately 110 decibels) when a DC power signal is supplied across the terminals of the siren. Switch SW1, which is mechanically operable in response to the turning of a key in a key lock, allows retail store salespersons to disable the siren S1 to remove or disconnect VCR 17 and prevent triggering of the audible alarm.

TABLE 1

| | |
|---|---|
| R1, R3, R5 | 10 k/.25 w 10 |
| R2, R4 | 1 k/.25 w 10 |
| C1 | 4.7 Microfarad/25 v |
| C2–5 | 2700 Picofarad/25 v |
| Q1 | ECG85, or 2N3860 |
| Q2 | ECG199 or 2N5172 |
| D1 | LED (Green) |
| D2 | LED (Red) |
| SW1 | Key Switch |
| S1 | Siren |

It should be recognized that the embodiment disclosed is designed to readily connect to VCRs, however other electronic audio/visual equipment may also be connected to the modules 16, via suitable mating connectors, and utilize the common signal ground between an input and an output connector or a left and right audio channel connector of audio/visual equipment for establishing a series electronic security loop circuit such as that created by the signal paths 12 shorted to signal paths 12*a*–12*e*. Examples of such devices include: preamplifiers, amplifiers, tuners, audio cassette players, compact disk players, Digital Audio Tape (DAT) players, and audio sound shaping equipment such as equalizers or surround sound decoders.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An anti-theft device for detecting the disconnection of an electronic device which includes a first connector and a second connector, the first and second connectors each having a signal conductor and a common conductor and wherein the common conductors of the first and second connectors are electrically shorted, said anti-theft device comprising:

circuit means for producing an alarm signal, said circuit means including a loop input and a loop output, said circuit means producing an alarm signal when said loop input is electrically disconnected from said loop output;

a source connector connected to the first connector, said source connector including a signal conductor and a common conductor which are connected to the respective conductors of said first connector, said loop input also connected to the common conductor of said source connector;

a playback connector connected to the second connector, said playback connector including a signal conductor and a common conductor which are connected to the respective conductors of said second connector, said loop output also connected to said playback connector common conductor; and alarm means responsive to said alarm signal for indicating when said alarm signal is present.

2. The device of claim 1 wherein said source connector and said playback connector each include decoupling means for decoupling the common conductors of said source connector and said playback connector from a signal source device and a playback device, respectively.

3. The device of claim 2 wherein said decoupling means are series connected capacitors.

4. The device of claim 1 wherein said alarm means includes an audible or visible alarm signal.

5. The device of claim 1 including a key lock switch for disabling said alarm means when said key lock switch is activated.

6. An anti-theft device for detecting the disconnection of one of a plurality of electronics devices from a series loop circuit, wherein each electronic device includes a first connector and a second connector, and wherein the first and second connectors have a signal conductor and a common conductor and the common conductors of the first and second connectors are electrically shorted within each electronic device, said anti-theft device comprising:

circuit means for producing an alarm signal, said circuit means including a loop input and a loop output, said circuit means producing an alarm signal when said loop input is electrically disconnected from said loop output;

a plurality of device connection modules each connectable to one of said plurality of electronic devices, wherein each connection module includes a source connector connected to the first connector of a corresponding electronic device, said source connector including a signal conductor and a common conductor which are connected to the respective conductors of said first connector of said corresponding device, each of said connection modules also including a playback connector connected to the second connector of a corresponding electronic device, said playback connector including a signal conductor and a common conductor which are connected to the respective conductors of said second connector of said corresponding device;

wherein said plurality of device connection modules are interconnected in a series loop circuit such that one of said modules has one of its common conductors connected to said loop input, and another one of said plurality of device connection modules has one of its common conductors connected to said loop output, and each remaining connection module is connected in series to form said series loop circuit through said common conductors of said source and playback connectors such that the electronic device completes a circuit from each of said source connector common conductors to said playback connector common conductors of each of said modules; and signalling means responsive to said alarm signal for indicating when said alarm signal is present.

7. The device of claim 6 wherein said plurality of device connection modules are wall mountable and each also includes isolation means connected to each of said source and playback connectors for decoupling said electronic device from signal source and playback devices.

8. The device of claim 7 wherein said signalling means is an audible alarm.

9. The device of claim 7 wherein said signalling means is a visual alarm.

10. The device of claim 8 including a switch for disabling said audible alarm.

11. The device of claim 10 wherein said switch is a key lock activated switch.

12. The device of claim 11 wherein said electronics device is a VCR, and said first connector is an antenna in connector and said second connector is a RF signal out connector of said VCR.

13. The device of claim 6 wherein said electronics device is an audio playback device wherein said first and second connectors are left and right channel audio playback connectors.

14. The device of claim 6 wherein said electronics device is an audio playback device wherein said first and second connectors are left and right channel audio record connectors.

15. The device of claim 6 wherein said electronics device is an audio playback device wherein said first connector is an audio record connector and said second connector is an audio playback connector.

16. The device of claim 6 wherein said first, second, source and playback connectors are coaxial connectors.

17. An anti-theft device for detecting the disconnection of an electronic device which includes a first connector and a second connector, the first and second connectors each having a signal conductor and a common conductor and wherein the common conductors of the first and second connectors are electrically shorted, said anti-theft device comprising:

circuit means for producing an alarm signal, said circuit means including a loop input and a loop output, said circuit means operable to produce an alarm signal when said loop input is electrically disconnected from said loop output;

power supply means for supplying a power signal to said circuit means;

a source connector connectable to the first connector, said source connector including a signal conductor and a common conductor which are electrically compatible with the corresponding conductors of said first connector, said loop input being connected to the common conductor of said source connector;

a playback connector connectable to the second connector, said playback connector including a signal conductor and a common conductor which are electrically compatible with the corresponding conductors of said second connector, said loop output being connected to the common conductor of said playback connector; and alarm means responsive to said alarm signal for indicating when said alarm signal is present.

* * * * *